US012686986B2

(12) United States Patent
Hegarty et al.

(10) Patent No.: US 12,686,986 B2
(45) Date of Patent: Jul. 21, 2026

(54) GROUND ANCHOR ASSEMBLIES, ADAPTOR ASSEMBLIES, AND POLE ASSEMBLIES

(71) Applicant: LIBERTY HARDWARE MFG. CORP., Winston-Salem, NC (US)

(72) Inventors: Robert Douglas Hegarty, Winston-Salem, NC (US); Kelly Nicole Pifer, Winston-Salem, NC (US); Jeffrey John Mathison, Chicago, IL (US); Melissa Hernandez, Winston-Salem, NC (US); Amy Chamberlain, Winston-Salem, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 197 days.

(21) Appl. No.: 18/465,365

(22) Filed: Sep. 12, 2023

(65) Prior Publication Data

US 2025/0084603 A1 Mar. 13, 2025

(51) Int. Cl.
*E02D 5/80* (2006.01)

(52) U.S. Cl.
CPC ..... *E02D 5/801* (2013.01); *E02D 2200/1671* (2013.01)

(58) Field of Classification Search
CPC . E04H 12/2223; E04H 12/2269; E04H 12/22; E02D 5/801
USPC ..... 52/157
See application file for complete search history.

(56) References Cited

U.S. PATENT DOCUMENTS

| | | | | |
|---|---|---|---|---|
| 3,636,670 A | | 1/1972 | Frye | |
| 4,920,897 A | * | 5/1990 | Reed | A47B 37/04 108/150 |
| 5,098,057 A | | 3/1992 | Gran et al. | |
| 5,135,192 A | | 8/1992 | Winkler | |
| 5,295,766 A | | 3/1994 | Tiikkainen | |
| 5,921,035 A | * | 7/1999 | Kempf | E04H 12/2223 52/165 |

(Continued)

FOREIGN PATENT DOCUMENTS

| | | |
|---|---|---|
| DE | 2731116 A1 | 1/1979 |
| EP | 0033305 B1 | 1/1981 |

(Continued)

OTHER PUBLICATIONS

Arlmont, "Bistro String Light Poles (Set of 2)", Wayfair, Jan. 24, 2023, 12 pages.

*Primary Examiner* — Paola Agudelo
(74) *Attorney, Agent, or Firm* — Brooks Kushman P.C.; Jeffrey Doyle

(57) ABSTRACT

A ground anchor assembly is provided with a base plate to be supported upon an underlying support surface. A helix extends from one side of the base plate for installation into the underlying support surface. A stake extends through the base plate at least partially into the helix to strengthen the helix, and for installation into the underlying support surface. An adaptor plate is sized to be supported upon the base plate and to receive a post. An adaptor assembly is provided with an adaptor plate to be supported upon an underlying support surface. A collar is formed in the adaptor plate. A sleeve is installed in the collar and sized to receive a post.

17 Claims, 5 Drawing Sheets

(56) References Cited

U.S. PATENT DOCUMENTS

| | | | | |
|---|---|---|---|---|
| D416,401 | S | 11/1999 | Taylor | |
| 6,655,648 | B2 * | 12/2003 | Harris | E02D 27/14 248/156 |
| D520,343 | S | 5/2006 | Powell | |
| D544,340 | S | 6/2007 | Powell et al. | |
| D550,071 | S | 9/2007 | Powell et al. | |
| 8,950,222 | B1 | 2/2015 | Bonnevie | |
| 9,464,397 | B1 | 10/2016 | Abraham | |
| 9,739,025 | B2 | 8/2017 | Brooks | |
| 10,008,134 | B2 | 6/2018 | Pura et al. | |
| 10,077,893 | B1 | 9/2018 | Abraham | |
| 10,227,787 | B2 | 3/2019 | Spano et al. | |
| 10,352,014 | B1 | 7/2019 | Baptiste | |
| D924,668 | S | 7/2021 | Brenizer, Jr. et al. | |
| 2004/0163336 | A1 * | 8/2004 | Hsu | E04H 12/2223 52/157 |
| 2005/0017148 | A1 * | 1/2005 | Tung | E04H 12/2269 248/910 |
| 2005/0116133 | A1 * | 6/2005 | Patsalaridis | E04H 12/2223 248/530 |
| 2007/0145225 | A1 * | 6/2007 | Bondy | E04H 12/2223 248/530 |
| 2011/0068236 | A1 | 3/2011 | Austin, III et al. | |
| 2015/0248852 | A1 * | 9/2015 | Todd | E04H 12/2238 52/745.18 |
| 2015/0368924 | A1 * | 12/2015 | Izradel | F21S 8/085 362/183 |
| 2018/0137790 | A1 * | 5/2018 | Pura | G09F 7/22 |
| 2020/0087918 | A1 * | 3/2020 | Nill | E04D 13/00 |
| 2023/0025229 | A1 * | 1/2023 | Eccard | E04H 12/182 |

FOREIGN PATENT DOCUMENTS

| | | | |
|---|---|---|---|
| EP | 3425139 | A1 | 1/2019 |
| GB | 2415441 | B | 7/2009 |
| GB | 2529840 | A | 3/2016 |
| WO | 8601849 | A1 | 3/1986 |

* cited by examiner

GROUND ANCHOR ASSEMBLIES, ADAPTOR ASSEMBLIES, AND POLE ASSEMBLIES

TECHNICAL FIELD

Various embodiments for ground anchor assemblies and adaptor assemblies are disclosed.

BACKGROUND

The prior art has provided ground anchor assemblies. The prior art has also provided adaptor assemblies to support a post.

SUMMARY

According to an embodiment, a ground anchor assembly is provided with a base plate to be supported upon an underlying support surface. A helix extends from one side of the base plate for installation into the underlying support surface. A stake extends through the base plate at least partially into the helix to strengthen the helix, and for installation into the underlying support surface. An adaptor plate is sized to be supported upon the base plate and to receive a post.

According to a further embodiment, the helix has a pitch. A distal end of the stake within the helix is angled relative to the base plate at an angle that is sized to match the pitch of the helix.

According to another further embodiment, the adaptor plate has an aperture formed therethrough sized to receive the stake.

According to a further embodiment, the stake extends through the aperture in the adaptor plate.

According to another further embodiment, a collar is formed in the adaptor plate, and the aperture is formed through the collar.

According to an even further embodiment, a sleeve is received in the collar, sized to receive the post.

According to another even further embodiment, the stake extends through the collar into the sleeve.

According to another further embodiment, the adaptor plate is further provided with a plurality of structural ribs to support the collar.

According to another further embodiment, fasteners are provided to fasten the adaptor plate to the base plate.

According to another embodiment, an adaptor assembly is provided with an adaptor plate to be supported upon an underlying support surface. A collar is formed in the adaptor plate. A sleeve is installed in the collar and sized to receive a post.

According to a further embodiment, an aperture is formed through the collar, sized to receive the sleeve.

According to another further embodiment, the adaptor plate is further provided with a plurality of structural ribs to support the collar.

According to another further embodiment, a plurality of fasteners is provided to fasten the adaptor plate to the underlying support surface.

According to another further embodiment, a ground anchor assembly is provided to attach directly to the underlying support surface. The adaptor plate is sized to attach to the ground anchor assembly.

According to a further embodiment, an aperture is formed through the collar, sized to receive the sleeve. The ground anchor assembly is further provided with a base plate to be supported upon the underlying support surface, and to support the adaptor plate. A stake extends through the base plate for installation into the underlying support surface, and through the collar aperture into the sleeve.

According to an even further embodiment, the ground anchor assembly is further provided with a helix extending from one side of the base plate for installation into the underlying support surface.

According to another even further embodiment, the stake extends at least partially into the helix to strengthen the helix.

According to another even further embodiment, the helix has a pitch. A distal end of the stake within the helix is angled relative to the base plate at an angle that is sized to match the pitch of the helix.

According to another further embodiment, fasteners are provided to fasten the adaptor plate to the base plate.

According to another embodiment, a ground anchor assembly is provided with a base plate to be supported upon an underlying support surface. A helix extends from one side of the base plate for installation into the underlying support surface. The helix has a pitch. A stake extends through the base plate at least partially into the helix to strengthen the helix, and for installation into the underlying support surface. A distal end of the stake within the helix is angled relative to the base plate at an angle that is sized to match the pitch of the helix.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
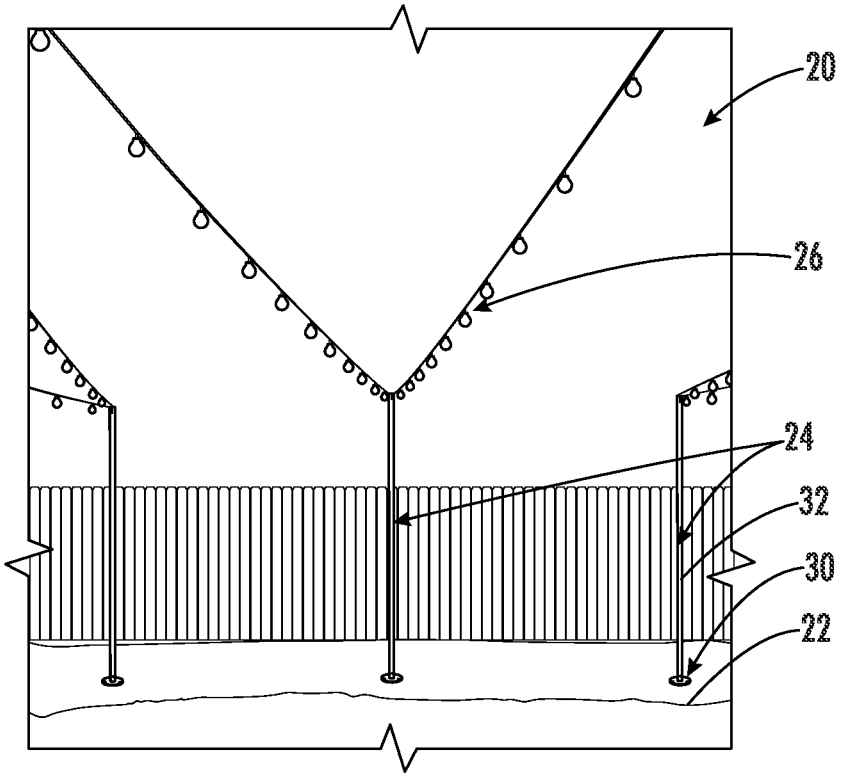
FIG. 1 is a perspective view of an outdoor environment with a plurality of pole assemblies according to an embodiment.
Figure 2:
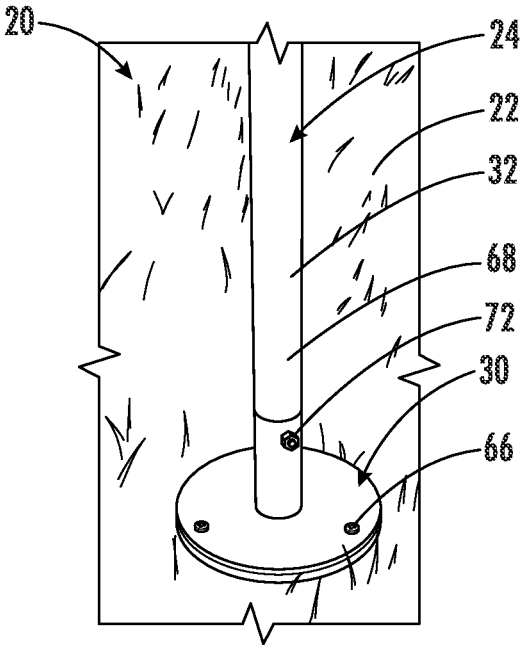
FIG. 2 is an enlarged partial perspective view of one of the pole assemblies of FIG. 1, illustrated installed into a first underlying support surface.

FIGS. 1 and 2 illustrate an outdoor environment 20 according to an embodiment. The environment 20 includes a grass yard 22 or ground 22. A plurality of pole assemblies 24 are installed upon the ground 22. The ground 22 provides an underlying support surface. In the depicted embodiment, the pole assemblies 24 are utilized to support a series of stringed lights 26. Of course, the pole assemblies 24 may be utilized to support other ornamentation, illumination, displays, banners, nets, or any material supportable by one or more pole assemblies 24. The pole assemblies 24 are often referred to as bistro pole assemblies 24.

Figure 3:
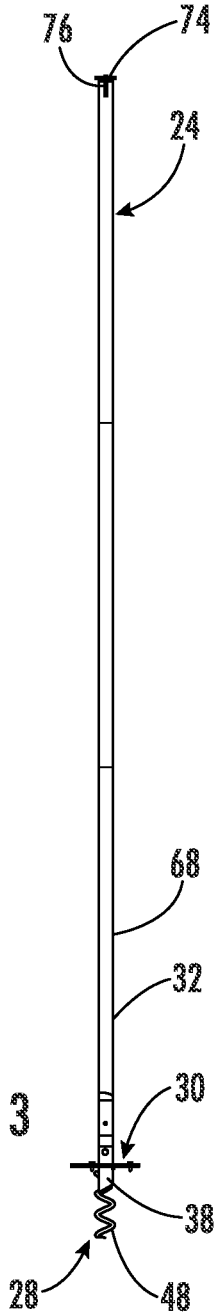
FIG. 3 is a side elevation view of one of the pole assemblies of FIG. 1.
Figure 4:
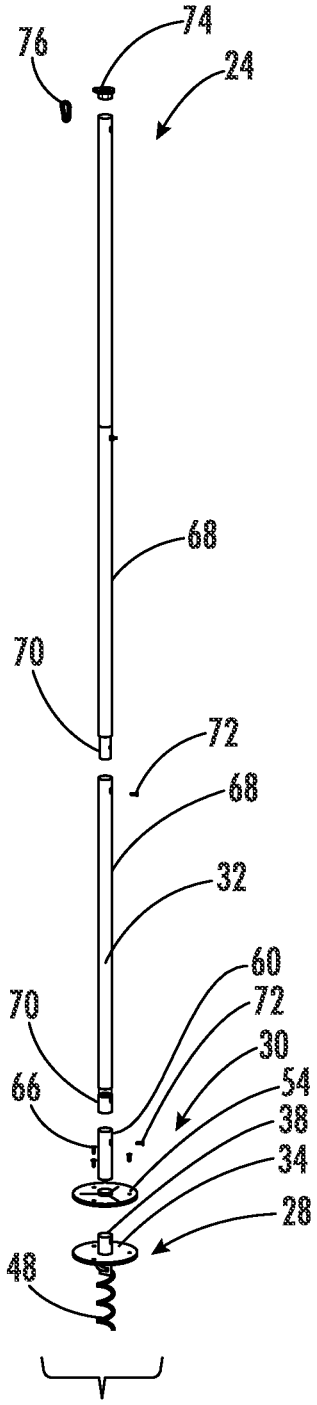
FIG. 4 is an exploded perspective view of the pole assembly of FIG. 3.

In FIGS. 1 and 2, the pole assemblies 24 are illustrated installed into the ground 22. With reference now to FIGS. 3 and 4, the pole assemblies 24 each include a ground anchor assembly 28 to install and support the pole assembly 24 upon the ground 22. The ground anchor assembly 28 is concealed beneath an adaptor assembly 30. The ground anchor assembly 28 and the adaptor assembly 30 cooperate to collectively support a pole 32.

Figure 5:
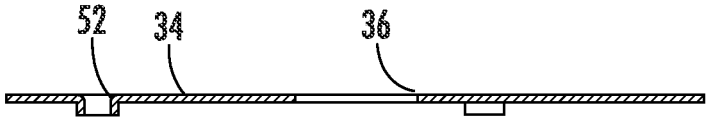
FIG. 5 is a side section view of a base plate of the pole assembly of FIG. 3.

The ground anchor assembly 28 includes a base plate 34 to rest directly upon the ground 22, and to distribute loading from the pole 32 to the ground 22. Referring to FIG. 5, the base plate 34 is a plate 34 that is generally flat within manufacturing tolerances. The base plate 34 may be stamped from a sheet material, such as a steel alloy. The base plate 34 includes a central aperture 36 formed therethrough, which is sized to receive a stake 38.

Figure 6:
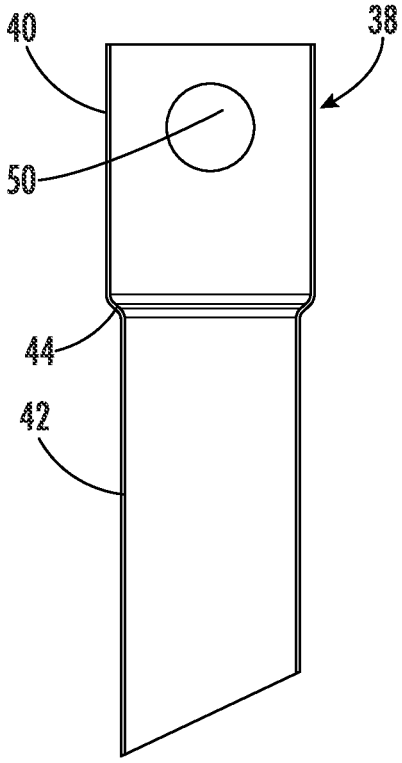
FIG. 6 is a side elevation view of a stake of the pole assembly of FIG. 3.
Figure 7:
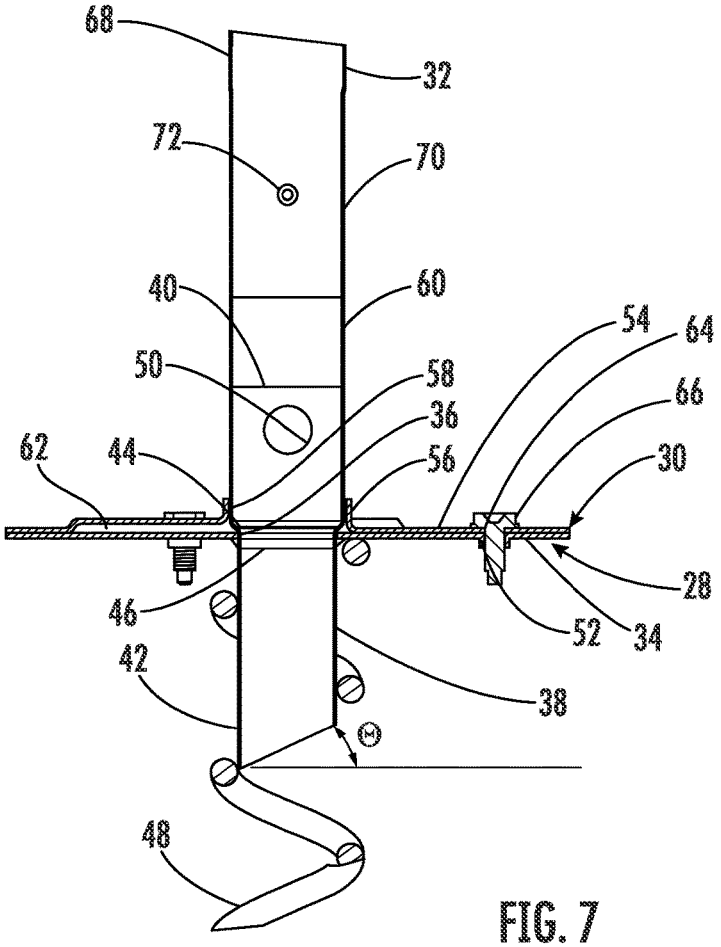
FIG. 7 is an enlarged partial section view of the pole assembly of FIG. 3.

The stake 38 is illustrated in FIG. 6. The stake 38 is formed from tubular stock, which may be cylindrical with a round cross section. The stake 38 has a region 40 with an enlarged diameter to provide an alignment shaft 40. The stake 38 also has a region 42 with a reduced diameter to provide a shank 42. The intersection 44 of the alignment shaft portion 40 and the shank portion 42 of the stake 38 provides a shoulder 44. The diameter of the shank 42 is sized to be received in the central aperture 36 of the base plate 34 as illustrated in FIG. 7. The shoulder 44 provides a limit of translation of the stake 38 into the central aperture 36. The stake 38 may also be formed from a steel alloy. Once installed, the stake 38 is welded to the base plate 34 at weld 46.

With continued reference to FIG. 7, the ground anchor assembly 28 also includes a helix 48 extending from an underside of the base plate 34. The helix 48 is formed from a steel wire with sufficient rigidity for ground installation. The helix 48 is wound around an inner diameter in a spiral shape for a rotary screw insertion and retention into the ground 22. The helix 48 is also welded to the base plate 34. The inner diameter of the helix 48 is sized to receive the shank 42 of the stake 38. The shank 42 of the stake 38 provides additional structural support to the helix 48.

The helix 48 and the stake 38 are installed into the ground 22 by rotation of the ground anchor assembly 28. As illustrated in FIGS. 6 and 7, a through aperture 50 is formed transversely through the shaft 40 of the stake 38. The through aperture 50 is sized to receive a rod, such as a shank of a tool for rotation of the shaft 40, and consequently rotation of the ground anchor assembly 28 during installation of the ground anchor assembly 28 into the ground 22.

For the depicted embodiment, the ground anchor assembly 28 is rotated clockwise, when viewed by the installer looking down upon the ground anchor assembly 28 and the ground 22. Initially, a distal end of the helix 48 contacts and penetrates the ground 22. Further rotation causes the helix 48 to follow a path of the distal end further into the ground 22, similar to a large threaded fastener. The mechanical assistance of the spiral 48 allows the user to readily overcome friction with the soil 22, making a stable and tight installation easier to achieve in dense soil. Upon further rotation, the shank 42 of the stake 38 is then installed into the ground 22 within the helix 48.

As illustrated in FIG. 7, the helix 48 has a pitch. For example, for a wire diameter of 9.5 millimeters, and an inner diameter of thirty-three millimeters, the pitch, or the displacement height for a full rotation of the helix 48 may be fifty-seven millimeters. A distal end of the shank 42 of the stake 38 is angled offset from a transverse plane by an angle that is sized to match the pitch of the helix 48. For example, the angle Θ in FIG. 7 may be twenty-five degrees to match the pitch of the helix 48 at an angle across a half rotation of the helix 48. The angle Θ may be within ten degrees of the corresponding half-rotation angle of the helix 48. By matching the angle Θ with the pitch of the helix 48, the stake 38 is inserted into the ground 22 at a similar rate as the translation of the helix 48 into the ground 22.

The stake 38 provides reinforcement to the helix 48 by providing an enhanced connection to the ground 22. The stake 38 also provides support between the base plate 34 and the helix 48 for improved vertical stability.

As illustrated in FIGS. 5 and 7, a plurality of apertures 52 are formed through the base plate 34. The apertures 52 are threaded for attachment of the adaptor assembly 30. The apertures 52 may also be embossed for enhanced threaded engagement.

Figure 8:
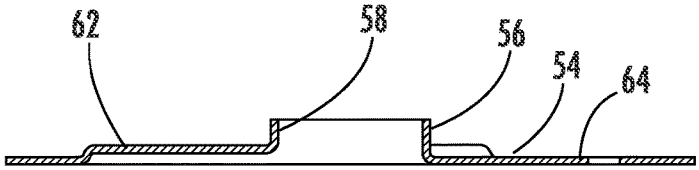
FIG. 8 is a side section view of an adaptor plate of the pole assembly of FIG. 3.
Figure 9:
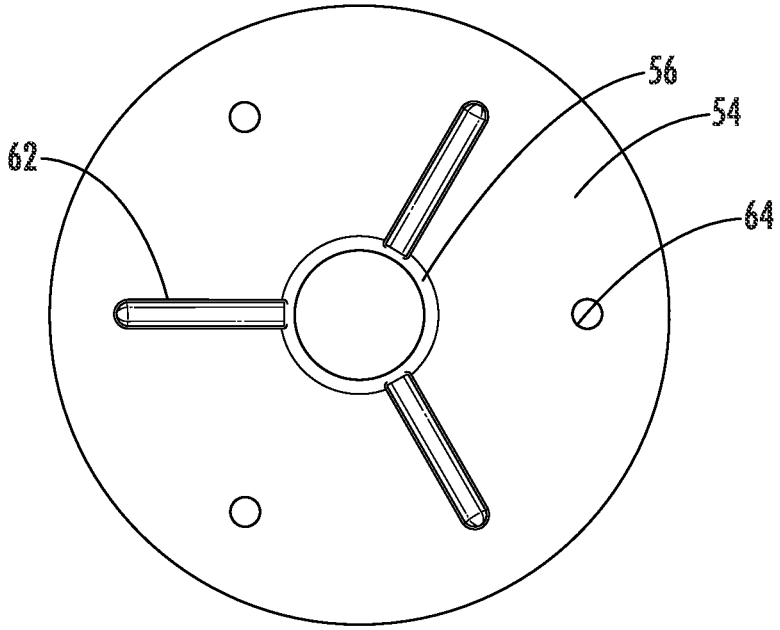
FIG. 9 is a top plan view of the adaptor plate of FIG. 8.

FIGS. 7-9 illustrate that the adaptor assembly 30 includes an adaptor plate 54. The adaptor plate 54 is sized to be received directly upon the base plate 34. The adaptor plate 54 conceals the ground anchor assembly 28. The adaptor plate 54 may be formed from a stamped steel alloy. The adaptor plate 54 may have a common footprint, such as a same diameter, as the base plate 34 to be supported upon the base plate 34 while concealing the base plate 34.

The adaptor plate 54 includes a collar 56 formed therein, with a through aperture 58. A sleeve 60 is installed in the collar aperture 58 as illustrated in FIGS. 4 and 7. According to an embodiment, the sleeve 60 is formed from a steel alloy and is welded to the collar 56. The sleeve 60 is sized to receive the post 32. Additionally, the sleeve 60 is also sized so that the shaft 40 of the stake 38 extends through the collar aperture 58 and into an inner diameter of the sleeve 60 as illustrated in FIG. 7.

FIGS. 7-9 illustrate a plurality of structural ribs 62 formed into the adaptor plate 54. The ribs 62 are arranged as a radial array of three ribs 62 extending from the collar 56. The ribs 62 provide additional structural support to the collar 56. A plurality of through apertures 64 are formed through the adaptor plate 54. The through apertures 64 have a hole pattern that aligns with a hole pattern of the threaded apertures 52 of the base plate 34. FIGS. 2, 4 and 7 illustrate that a plurality of threaded fasteners 66, such as machine screws 66, are installed in the through apertures 64 in the adaptor plate 54, and in threaded engagement with the threaded apertures 52 of the base plate 34 to fasten the adaptor assembly 30 to the ground anchor assembly 28.

The stake 38 cooperates with the sleeve 60 and the helix 48 to provide structural rigidity through the ground anchor assembly 28 and the adaptor assembly 30, thereby increasing stability of the entire pole assembly 24.

The pole 32 may include a plurality of pole segments 68 for reduction in size for packaging, retail, and transportation. As illustrated in FIGS. 4 and 7, a proximal end 70 of each pole segment 68 may be swaged with a reduced diameter. The proximal end 70 is sized to be received in the sleeve 60. A fastener 72 is installed transversely into the sleeve 60 and the proximal end 70 of the pole segment 68 to fasten and retain the pole segment 68 to the sleeve 60.

Referring again to FIGS. 3 and 4, the pole 32 is depicted with three pole segments 68, according to an example. Each pole segment 68 may include the swaged proximal end 70 that is sized to be received in the sleeve 60, or into a distal end of one of the other pole segments 68 as demonstrated in FIG. 4. Interconnected pole segments 68 are fastened together by one of the fasteners 72.

A cap 74 is provided to plug into a distal end of the uppermost pole segment 68. A carabiner 76 is attached to the cap 74. The carabiner 76 may be utilized to attach and support the residential string lights 26.

The pole assembly 24 may be installed into the ground 22, or alternatively, may be installed upon a rigid surface, such as concrete, a wooden deck, or the like. For installation upon non-ground surfaces, the ground anchor assembly 28 may be omitted. Instead, the adaptor assembly 30 can be fastened directly to the hardened surface. Instead of machine screws 66, the threaded fasteners 66 may be lag bolts 66 or anchor bolts 66 for installation into wood or concrete surfaces. The alternate fasteners 66 may be packaged and retailed with the pole assembly 24 to permit the user to install the pole assembly 24 into various underlying support surfaces.

Although the sleeve 60 is illustrated as cylindrical, with a round cross section to receive a pole 32, the sleeve 60 could be sized and arranged to receive various other components. For example, the sleeve 60 could be sized and shaped to receive a mailbox post, a four-by-four post, or the like. The adaptor assembly 30 can be modified to mount various components to an underlying support surface, and to conceal a ground anchor assembly 28. The apertures 64 in the adaptor plate 54 can be arcuate slots to permit pivotal adjustment of the adaptor assembly 30 relative to the ground anchor assembly 28 and/or the underlying support surface 22.

Figure 10:
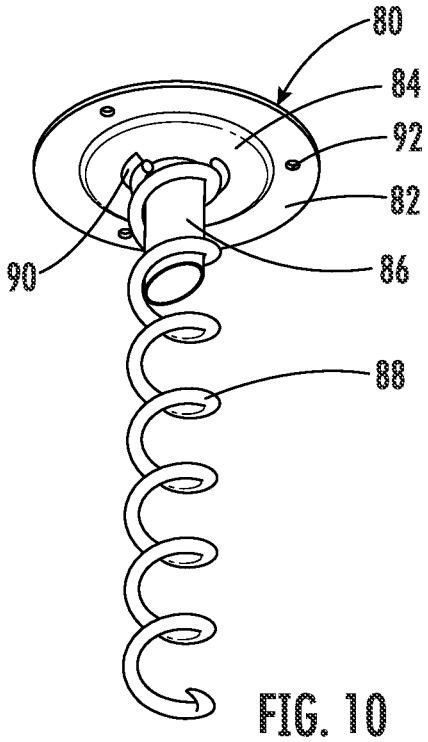
FIG. 10 is a perspective view of a ground anchor assembly according to another embodiment.

FIG. 10 illustrates a ground anchor assembly 80 according to another embodiment. The ground anchor assembly 80 includes a base plate 82 to rest directly upon the ground 22, and to distribute loading from the pole 32 to the ground 22. The base plate 82 includes a depressed portion 84 to partially conceal an installation feature. A stake 86 depends from the depressed portion 84. The ground anchor assembly 80 also includes a helix 88 extending from an underside of the recessed portion 84. The helix 88 is also welded to the base plate 82 at weld 90. The inner diameter of the helix 88 is sized to receive the stake 86. The stake 86 provides additional structural support to the helix 88. A plurality of apertures 92 are formed through the base plate 82. The apertures 92 are threaded for attachment of the adaptor assembly 30.

Figure 11:
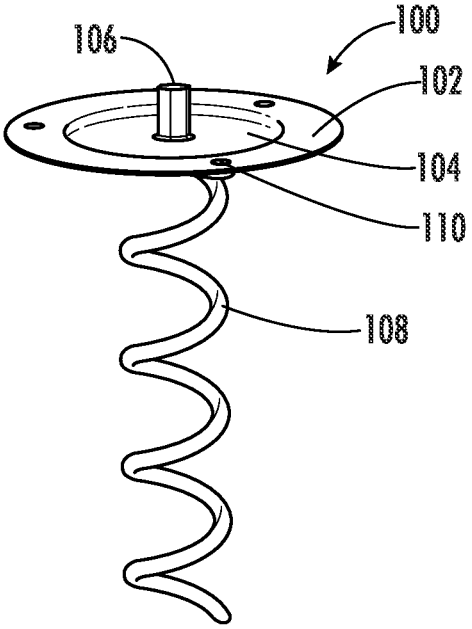
FIG. 11 is a perspective view of a ground anchor assembly according to another embodiment.

FIG. 11 illustrates a ground anchor assembly 100 according to another embodiment. The ground anchor assembly 100 includes a base plate 102 to rest directly upon the ground 22, and to distribute loading from the pole 32 to the ground 22. The base plate 102 includes a depressed portion 104. A tool coupler 106 is at least partially received in the depressed portion 104 and welded to the base plate 102. The coupler 106 has a plurality of wrench flats, such as a hexagonal headed fastener to permit a user to drive the anchor assembly with a wrench, a drill, of any suitable tool. The ground anchor assembly 100 also includes a helix 108 extending from an underside of the recessed portion 104. A plurality of apertures 110 are formed through the base plate 102. The apertures 110 are threaded for attachment of the adaptor assembly 30.

Figure 12:
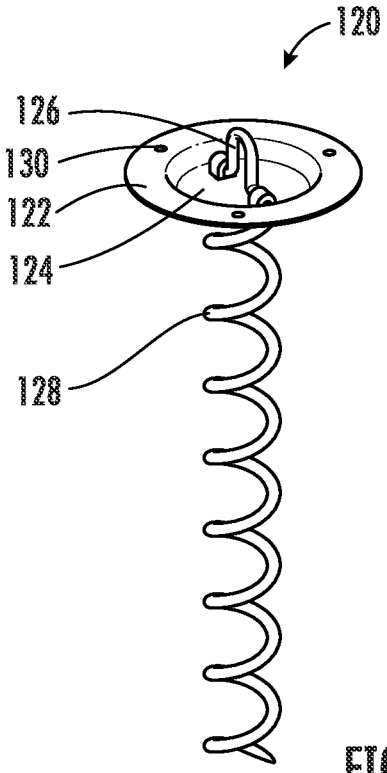
FIG. 12 is a perspective view of a ground anchor assembly according to another embodiment.

FIG. 12 illustrates a ground anchor assembly 120 according to another embodiment. The ground anchor assembly 120 includes a base plate 122 to rest directly upon the ground 22, and to distribute loading from the pole 32 to the ground 22. The base plate 122 includes a depressed portion 124. A folding ring or hasp 126 is at least partially received in the depressed portion 124. The ring 126 can be pivoted to the extended position as illustrated. A rod, such as a tool shank, may be inserted under to ring for manual rotation and installation of the ground anchor assembly 120. The ring 126 is also pivotal to a collapsed position for concealment within the depressed portion 124. The ground anchor assembly 120 also includes a helix 128 extending from an underside of the recessed portion 124. A plurality of apertures 130 are formed through the base plate 122. The apertures 130 are threaded for attachment of the adaptor assembly 30.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A ground anchor assembly comprising:

a base plate to be supported upon an underlying support surface;

a helix connected to, and extending from, one side of the base plate for installation into the underlying support surface;

a stake extending through the base plate at least partially into the helix to strengthen the helix, and for installation into the underlying support surface; and an adaptor plate sized to be supported upon the base plate and to receive a post;

wherein the helix has a pitch; and wherein a distal end of the stake within the helix is angled relative to the base plate at an angle that is sized to match the pitch of the helix.

2. The ground anchor assembly of claim 1 wherein the adaptor plate has an aperture formed therethrough sized to receive the stake.

3. The ground anchor assembly of claim 2 wherein the stake extends through the aperture in the adaptor plate.

4. The ground anchor assembly of claim 2 wherein a collar is formed in the adaptor plate, and the aperture is formed through the collar.

5. The ground anchor assembly of claim 4 wherein a sleeve is received in the collar, sized to receive the post.

6. The ground anchor assembly of claim 5 wherein the stake extends through the collar into the sleeve.

7. The ground anchor assembly of claim 4 wherein the adaptor plate further comprises a plurality of structural ribs to support the collar.

8. The ground anchor assembly of claim 7 wherein the plurality of structural ribs is stamped into the adaptor plate.

9. The ground anchor assembly of claim 1 further comprising fasteners to fasten the adaptor plate to the base plate.

10. The ground anchor assembly of claim 1 wherein a shoulder is formed about the stake, sized to contact the base plate to limit translation of the stake through the base plate.

11. The ground anchor assembly of claim 1 further comprising a ring received in a depressed portion of the base plate.

12. An adaptor assembly comprising:

a ground anchor assembly to attach directly to a first underlying support surface;

an adaptor plate sized to be attached to the ground anchor assembly in a ground installation, and sized to be supported upon a second underlying support surface in a second non-ground installation;

a collar formed in the adaptor plate;

a sleeve installed in the collar and sized to receive a post; and fasteners to fasten the adaptor plate to the ground anchor assembly in the ground installation and to fasten the adaptor plate to the second underlying support surface in the non-ground installation;

wherein an aperture is formed through the collar, sized to receive the sleeve;

wherein the ground anchor assembly further comprises:

a base plate to be supported upon the underlying support surface, and to support the adaptor plate, a stake extending through the base plate for installation into the underlying support surface, and through the collar aperture into the sleeve, a helix extending from one side of the base plate for installation into the underlying support surface;

wherein the stake extends at least partially into the helix to strengthen the helix;

wherein the helix has a pitch; and wherein a distal end of the stake within the helix is angled relative to the base plate at an angle that is sized to match the pitch of the helix.

13. The adaptor assembly of claim 12 wherein an aperture is formed through the collar, sized to receive the sleeve.

14. The adaptor assembly of claim 12 wherein the adaptor plate further comprises a plurality of structural ribs to support the collar.

15. The adaptor assembly of claim 12 wherein the fasteners are operable to fasten the adaptor plate to the base plate.

16. A ground anchor assembly comprising:

a base plate to be supported upon an underlying support surface;

a helix extending from one side of the base plate for installation into the underlying support surface, wherein the helix has a pitch; and a stake extending through the base plate at least partially into the helix to strengthen the helix, and for installation into the underlying support surface, wherein a distal end of the stake within the helix is angled relative to the base plate at an angle that is sized to match the pitch of the helix.

17. A ground anchor assembly comprising:

a base plate to be supported upon an underlying support surface;

a helix connected to, and extending from, one side of the base plate for installation into the underlying support surface;

a stake extending through the base plate at least partially into the helix to strengthen the helix, and for installation into the underlying support surface;

an adaptor plate sized to be supported upon the base plate and to receive a post; and a ring received in a depressed portion of the base plate.

* * * * *